US005195633A

United States Patent [19]

Kaminski

[11] Patent Number: 5,195,633

[45] Date of Patent: Mar. 23, 1993

[54] GOLF BALL DISPLAY DEVICE

[76] Inventor: David Kaminski, 2496 Kingsbury, Troy, Mich. 48098

[21] Appl. No.: 826,117

[22] Filed: Jan. 27, 1992

[51] Int. Cl.[5] ..... B65D 85/00

[52] U.S. Cl. ..... 206/315.9; 206/45.31; 206/486; 206/490; 211/14

[58] Field of Search ..... 206/315.9, 45.31, 486, 206/490, 488; 211/14

[56] References Cited

U.S. PATENT DOCUMENTS

| | | | |
|---|---|---|---|
| 1,342,733 | 6/1920 | Austin | 211/14 X |
| 2,890,790 | 6/1959 | Gibson, Jr. | 206/315.9 X |
| 3,127,302 | 3/1964 | Bunting | 206/486 X |
| 3,136,419 | 6/1964 | Ruderian | 206/493 X |
| 4,296,874 | 10/1981 | Evans . | |
| 4,917,282 | 4/1990 | Hufford | 211/14 X |

*Primary Examiner*—Byron P. Gehman
*Attorney, Agent, or Firm*—Charles W. Chandler

[57] ABSTRACT

A display for holding a golf ball for viewing includes a pair of body members, including a front body member having an opening for viewing a portion of the golf ball surface, and an internal opening behind the viewing opening for accommodating the ball such that it is trapped between the two body members.

6 Claims, 1 Drawing Sheet

GOLF BALL DISPLAY DEVICE

BACKGROUND OF THE INVENTION

This invention relates to a decorative device for displaying a golf ball. Many holders are known in the prior art for dispensing golf balls during play. One such example is illustrated in U.S. Pat. No. 4,296,874 which was issued Oct. 27, 1981 to Roger C. Evans. Evans discloses a tubular device containing three balls. The housing has three openings for viewing the balls. The housing is formed of an elastic material and has a dispensing opening for releasing an individual ball.

SUMMARY OF THE INVENTION

The preferred embodiment of the present invention comprises a golf ball display device formed of two elongated body members, for displaying three golf balls. However, the invention can be used for displaying an individual ball or several balls in a variety of arrangements.

The two body members are formed of wood, however, other suitable materials may be used. The front body member has three viewing openings, one for each ball. Each viewing opening has a diameter less than the diameter of its ball. The front body member also has a larger interior opening, behind the viewing opening, with a diameter accommodating the ball. The rear body member is fastened to the front body member, either with a threaded fastener or in a permanent manner. The balls are frictionally trapped between the two body members with an appropriate portion of each ball surface being exposed for viewing.

The display device has particular utility for those golfers who like to display balls obtained at prominent golf courses.

Still further objects and advantages will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF A PREFERRED EMBODIMENT OF THE INVENTION

Figure 1:
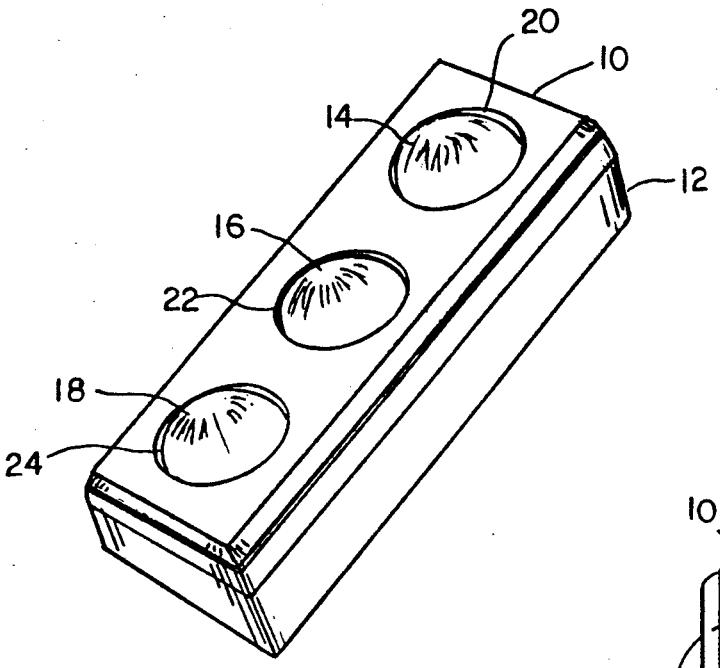
FIG. 1 is a perspective view of a preferred display device with three balls mounted for viewing.
Figure 2:
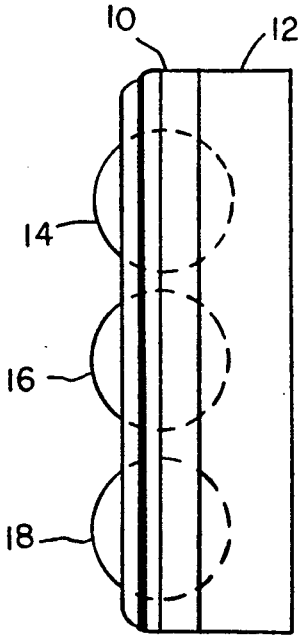
FIG. 2 is a side view of the display device with the three balls trapped between the front and rear body members.

Referring to the drawings, a preferred display device comprises a front body member 10 and a rear body member 12.

The two body members may be formed of a decoratively carved wood or other suitable material. For illustrative purposes, three identically-shaped golf balls 14, 16 and 18 are mounted in the display device.

The two body members have a length greater than the combined diameters of the three golf balls and a width greater than the golf ball diameter.

Front body member 10 has a thickness less than the diameter of a golf ball. The front body member has three identically-shaped, circular viewing openings 20, 22 and 24. Each viewing opening has a diameter less than a golf ball diameter.

Rear body member 12 also has a thickness less than a golf ball diameter and has a circular opening 26 rearward of viewing opening 20. Opening 26 preferably has a diameter less than that of the golf ball.

Figure 3:
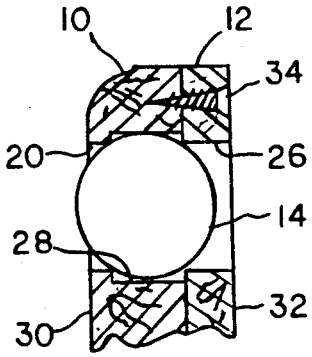
FIG. 3 is a sectional view showing the manner in which a typical golf ball is trapped between the front and rear body members.

Referring to FIG. 3, front body member 10 also has an inner cylindrical opening 28 behind each of the viewing openings. Cylindrical opening 28 has a diameter that forms a frictional fit with the golf ball. Opening 28 is disposed behind the outer surface 30 of the front body member, a distance that permits the ball surface to project beyond the plane of surface 30.

The thickness of the rear body member is such that the rearward surface of the ball is disposed within the profile of the rear surface 32 of the rear body member. Threaded fastener means 34 releasably fasten the rear body member to the front body member such that each ball is frictionally trapped between the two body members. Ball 14, as well as the other balls may be rotated to view different portions of the ball surface through its respective viewing opening. However, none of the balls can be removed from the display device without removing the back body member.

The display device can either be mounted on a desk, for example, or hung from a wall because each ball is mounted within the profile of rear surface 32.

The invention can be employed in an appropriate display device for displaying either an individual ball or several balls with the openings disposed either in a linear or some other decorative arrangement.

The rear body member can also be permanently fastened to the front body member.

The interior opening 28 can be formed partially in the rear body member or totally within the rear body member by reducing the thickness of the front body member and increasing the thickness of the rear body member. Further, the display device can be formed by increasing the thickness of the front body member so that the rear body member does not have an opening, but merely traps the ball in an interior cavity formed by opening 28.

Having described my invention, I claim:

1. A display device for a golf ball, comprising:

a front body member of a rigid material having an outer, front surface with a viewing opening, the viewing opening having a diameter less than that of a golf ball;

a rear body member of a rigid material disposed behind the front body member, the rear body member having a rear surface;

the front and rear body members having internal structure defining a pair of spaced, aligned, annular shoulders including a front shoulder, the front shoulder being spaced behind the viewing opening, and a rear shoulder located forward of the rear surface of the rear body member;

the front shoulder and the rear shoulder each having a diameter less than that of a golf ball and being spaced a distance less than the diameter of a golf ball, and means for connecting the front body member to the rear body member to retain a golf ball between the front shoulder and the rear shoulder in a position in which a portion of the surface of a retained golf ball may be viewed through the viewing opening, and a retained golf ball is recessed from the rear surface of the rear body member so the rear surface of the display device may be disposed on a flat surface.

2. A display device as defined in claim 1, in which the front body member has a planar outer surface and a retained golf ball would project beyond the plane of the outer surface.

3. A display device as defined in claim 1, in which the front body member has a plurality of spaced viewing openings, and the rear body member has an opening rearward of each of the viewing openings for accommodating a golf ball in a retained position behind each of the viewing openings.

4. A combination, comprising:

a golf ball;

a front body member of a rigid material having an outer, front surface with a viewing opening, the viewing opening having a diameter less than that of the golf ball;

a rear body member disposed behind the front body member, the rear body member having a rear surface;

the front and rear body members having internal structure defining a pair of spaced, aligned, annular shoulders including a front shoulder, the front shoulder being spaced behind the viewing opening, and a rear shoulder located forward of the rear surface of the rear body member, the front and rear shoulders each having a diameter less than that of the golf ball and being spaced a distance less than the diameter of the golf ball, and means for connecting the front body member to the rear body member to retain the golf ball between the front shoulder and the rear shoulder in a position in which a portion of the surface of the golf ball may be viewed through the viewing opening, and the golf ball is recessed from the rear surface of the rear body member so the rear surface thereof may be disposed on a flat surface.

5. A display device as defined in claim 4, in which the front body member has a planar outer surface, and the retained golf ball projects beyond the plane of the outer surface.

6. A display device as defined in claim 4, in which the front body member has a plurality of spaced viewing openings, and one of the body members has an opening rearward of each of the viewing openings for accommodating a retained golf ball in a trapped position behind each of the viewing openings.

* * * * *